United States Patent [19]

Nakamura et al.

[11] 4,007,237

[45] Feb. 8, 1977

[54] COMPENSATION APPARATUS FOR CARBURETOR

[75] Inventors: Norihiko Nakamura, Mishima; Hiromichi Yanagihara, Susono, both of Japan

[73] Assignee: Toyota Jidosha Kogyo Kabushiki Kaisha, Toyota, Japan

[22] Filed: Aug. 25, 1975

[21] Appl. No.: 607,447

[30] Foreign Application Priority Data

Apr. 19, 1975 Japan ..... 50-048023

[52] U.S. Cl. ..... 261/41 D

[51] Int. Cl.[2] ..... F02M 7/06

[58] Field of Search ..... 261/41 D

[56] References Cited

UNITED STATES PATENTS

| | | | |
|---|---|---|---|
| 1,838,675 | 12/1931 | Heitger | 261/41 D |
| 2,339,320 | 1/1944 | Carlson et al. | 261/41 D |
| 2,674,443 | 4/1954 | Bracke | 261/41 D |
| 2,827,269 | 3/1958 | Kittler | 261/41 D |
| 3,169,154 | 2/1965 | Martin et al. | 261/41 D |
| 3,333,833 | 8/1967 | Bimberg | 261/41 D |
| 3,414,242 | 12/1968 | Bouteleux | 261/41 D |
| 3,608,874 | 9/1971 | Beckmann | 261/41 D |
| 3,661,367 | 5/1972 | Mennesson | 261/41 D |
| 3,878,271 | 4/1975 | Garcea | 261/41 D |
| 3,931,372 | 1/1976 | Pierlot | 261/41 D |

*Primary Examiner*—Tim R. Miles
*Attorney, Agent, or Firm*—Woodhams, Blanchard and Flynn

[57] ABSTRACT

A compensation apparatus for a carburetor having a first opening in the wall of the air intake passage near the edge of the throttle valve so that the first opening is positioned upstream or downstream of the throttle valve depending on the degree of opening thereof. A second opening is similarly provided in the wall of the air intake passage so that it is positioned downstream of the throttle valve, at least when the first opening is positioned upstream thereof. A connecting passage joins the first and second openings, and a further passage supplies fuel to the connecting passage. Air is reversely bled through the first opening and fuel is discharged through the second opening, whereby fuel shortage due to response delay in the transitional region between the low-speed and high-speed phases, or in the transitional region between the idling and the low-speed phases, is prevented.

9 Claims, 8 Drawing Figures

COMPENSATION APPARATUS FOR CARBURETOR

FIELD OF THE INVENTION

The present invention relates to a compensation apparatus for a carburetor used with an internal combustion engine.

BACKGROUND OF THE INVENTION

In an ordinary carburetor, fuel is introduced through an idle port when the engine is idled, through a slow port when it is driven at low speeds, and through a main nozzle when it is driven at high speeds. In carburetors of this conventional type, however, it is difficult to attain a correct air-fuel ratio due to shortage of fuel, especially in a transitional state between the low-speed and high-speed operational phases. Particularly, when such transition occurs abruptly, it is difficult to obtain a correctly proportioned fuel-air mixture, thus causing non-uniform rotation of the engine. Therefore, in order to prevent such fuel shortage during acceleration, ordinary carburetors have been equipped with an accelerating pump which supplies fuel interlockingly with the rotation of a throttle valve shaft. By thus supplying fuel to a stream of sucked air when accelerating, that is, when the vehicle accelerator pedal is depressed, the delay in fuel supply response during acceleration and the diluting of fuel-air mixture in the transitional region have been at least partially prevented.

However, since it is operated mechanically, such conventional accelerating equipment is slow to respond so that it also causes some delay in supplying the necessary fuel to the air intake passage. Therefore, it has been impossible to perfectly prevent the transitional dilution of the fuel-air mixture.

An object of this invention is to provide a compensation apparatus for correcting the defective delay in response produced by the conventional mechanically operated accelerating pump, and, further, for preventing the shortage of fuel in the transitional region between the low-speed and high-speed operational phases.

Another object of this invention is to provide a compensation apparatus for discharging fuel directly in response to the opening of the throttle valve.

The compensation apparatus of this invention provides a first opening in the wall of the air intake passage near the edge of the throttle valve so that the first opening is positioned upstream or downstream of the throttle valve depending on the degree of opening thereof. A second opening is similarly provided in the wall of the air intake passage so that it is positioned downstream of the throttle valve, at least when the first opening is positioned upstream thereof. A connecting passage joins the first and second openings, and a further passage supplies fuel to the connecting passage.

According to this invention, as described above, air is reversely bled through the first opening and fuel is discharged through the second opening, whereby fuel shortage due to response delay in the transitional region between the low-speed and high-speed phases, or in the transitional region between the idling and the low-speed phase, is prevented.

DETAILED DESCRIPTION

Figure 1:
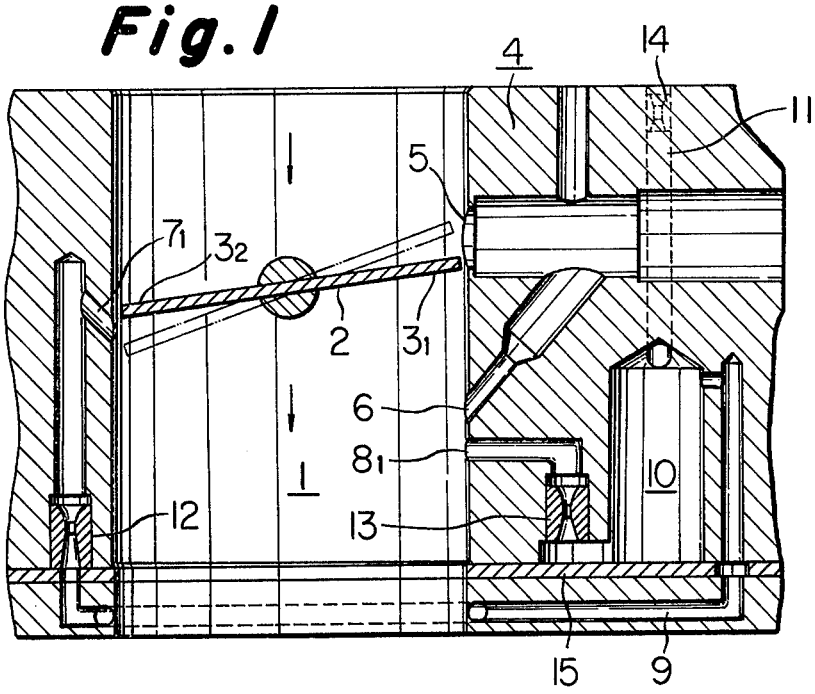
FIG. 1 is a cross-sectional view showing an embodiment of this invention.

Referring first to FIG. 1, the structure of a first embodiment of this invention will be described.

A conventional swingable throttle valve 2 is provided in an air intake passage 1, in which passage a stream of sucked air flows from above to below as indicated by the arrows. In that side of wall 4 of said air intake passage which is near an edge $3_1$ of said throttle valve 2, there is provided a slow port 5, and an idle port 6 is provided downstream thereof. Fuel is supplied to the slow port 5 and idle port 6 in a conventional manner through a suitable bleeding device.

The foregoing structure is conventional in known carburetors.

According to this invention, however, a first opening $7_1$ is provided in that side of wall 4 of said air intake passage which is near the opposite edge $3_2$ of said throttle valve 2, which edge $3_2$ moves in a downstream direction with respect to the stream of sucked air as the throttle valve 2 opens. This first opening $7_1$ is positioned upstream or downstream of the throttle valve 2 depending on the degree of its opening. When the first opening $7_1$ is positioned upstream of the throttle valve 2 (as indicated by the dash-dot line position of valve 2), it is subjected to a high pressure (approximately atmospheric). When opening $7_1$ is positioned downstream of valve 2 (as indicated by the solid line position of valve 2), it is subjected to a low pressure (i.e a negative pressure in the air intake passage). There is also provided in the wall 4 of the air intake passage a second opening $8_1$ which is positioned downstream of the throttle valve 2, at least when the first opening $7_1$ becomes positioned upstream thereof. These first and second openings $7_1$ and $8_1$ are connected by a passage 9, and, preferably, a fuel reservoir 10 is provided therebetween. This fuel reservoir 10 has sufficient capacity for maintaining a given amount of fuel in the system comprising the passage 9 connecting said first and second openings $7_1$ and $8_1$. A passage 11 is provided for supplying fuel to the fuel reservoir 10. A jet 12 is provided between the fuel reservoir 10 and the first opening $7_1$ , and another jet 13 is provided between said fuel reservoir 10 and the second opening $8_1$, for the purpose of measuring the flow rates of fuel. A jet 14 is also provided in the passage 11 to measure the quantity of fuel supplied. In order to facilitate its manufacture, the passage 9 is provided in a heat insulator 16 which is maintained airtight through a gasket 15.

The operation of the FIG. 1 embodiment will now be described.

When an engine is being idled, fuel is supplied mainly through the idle port 6. At this time, the throttle valve 2 is in a closed position as indicated by the solid line, and the first opening $7_1$ is located downstream of the throttle valve 2. Therefore, the negative pressure in the air intake passage is working on both of the first and second openings $7_1$ and $8_1$. It is possible to store almost all the fuel supplied through the passage 11 in the fuel reservoir 10, by decreasing the quantities of fuel introduced through the openings $7_1$ and $8_1$ during idling by means of the selective actions of said jets 12 and 13. If the throttle valve 2 is opened to a position indicated by the dot-dash line or more, the engine proceeds from idling to low-speed, or even faster, operation. Then, the fuel necessary for low-speed operation is supplied through the slow port 5. However, there has conventionally arisen some response delay when switching from the so-called idling phase, wherein fuel is supplied through the idle port 6, to the low-speed phase wherein fuel is supplied through the slow port 5. A similar response delay in the transitional region has also occurred when proceeding from the low-speed phase to the high speed phase. In such transitional regions, a proper air-fuel ratio was unobtainable. According to this invention, however, when going from the idling to the low-speed phase, the opening of throttle 2 causes the edge $3_2$ of the throttle valve 2 to move downward, whereby the first opening $7_1$ becomes positioned upstream of the throttle valve. This produces a pressure difference between the high pressure which is applied on this first opening $7_1$ as positioned upstream of the throttle valve and the negative pressure which is applied on the second opening $8_1$, which opening $8_1$ is positioned downstream of valve 2. Due to this pressure difference, the fuel stored in the passage 9 and fuel reservoir 10 is injected through the jet 13 and the second opening $8_1$ into the air intake passage 1. This fuel injection through the second opening $8_1$ is effected quickly because a large pressure difference is produced by using the negative pressure in the air intake passage. Consequently, the response delay in the transitional region between the idling and low-speed phases can be perfectly compensated. Further, the diluting of the fuel-air mixture can also be prevented.

The above-described embodiment is designed to compensate for the fuel shortage due to the delay in response in the transient region that arises when proceeding from the idling system to the low-speed system, and also due to the delay in the response of the mechanically operated accelerating pump. However, it is also possible to make such a design that compensates for the shortage of fuel in the transitional region between the low-speed and high-speed systems, as illustrated in FIG. 2.

In this embodiment, a first opening $7_2$ is formed in the wall 4 of the air intake passage 1 and is positioned slightly downstream of the edge $3_2$ of the throttle valve 2 when the opposite edge $3_1$ thereof approaches the upper edge 17 of the slow port 5.

Figure 2:
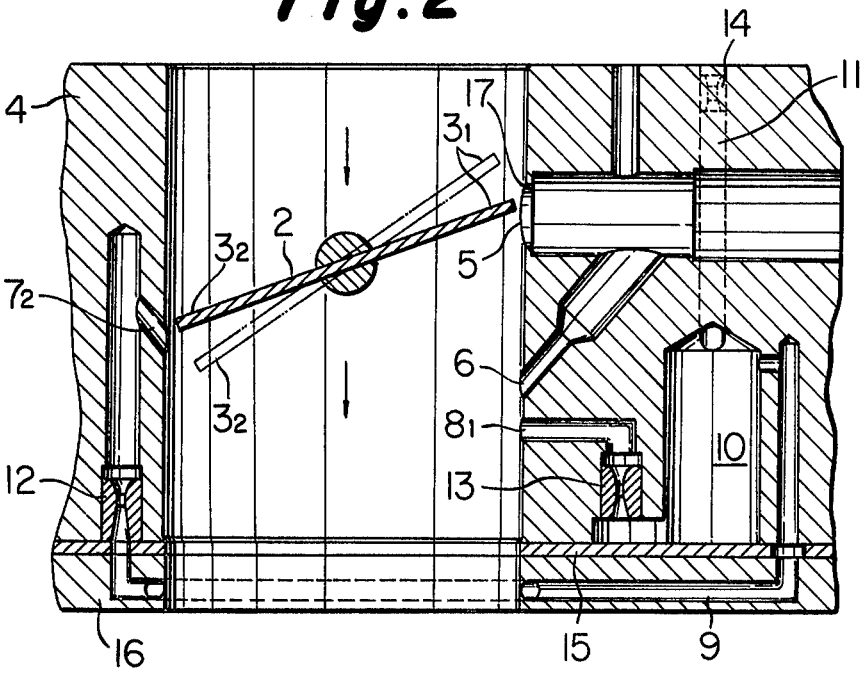
FIG. 2 is a cross-sectional view of a further embodiment for accomplishing fuel compensation in a different transitional region from that described with reference to FIG. 1.

In the embodiment shown in FIG. 2, the pressure working on the first opening $7_2$ changes from the negative pressure in the air intake passage to an almost atmospheric pressure in the transitional region that arises when the throttle valve 2 moves in an opening direction from the low-speed position (indicated by a solid line) to the high-speed position (indicated by a dot-dash line). That is, when the throttle valve 2 is in a partially open position (as shown by a solid line) which corresponds to a low-speed operation, the opening $7_2$ is still located downstream of the edge $3_2$. In this partially open position, the slow port 5 is downstream of edge $3_1$ to permit proper fuel injection for low-speed operation. Then, due to the pressure difference on openings $7_2$ and $8_1$, fuel is injected through the second opening $8_1$ into the passage 1 at a very rapid response speed.

The above-described embodiments shown in FIGS. 1 and 2 have disclosed that the position of the first opening $7_1$ or $7_2$ can be selected suitably. Similarly, the position of the second opening $8_1$ may also be suitably selected.

Figure 3:
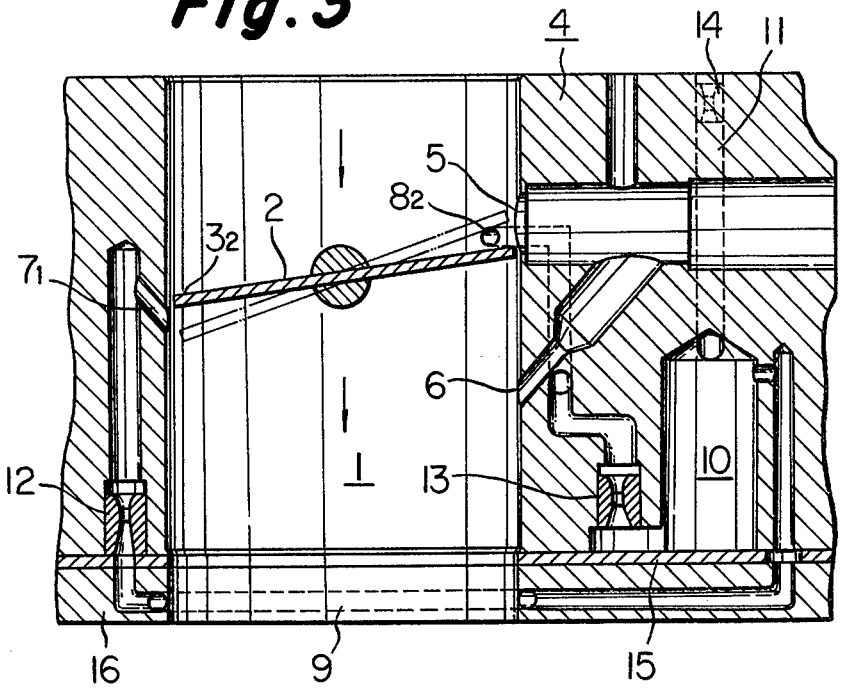
FIG. 3 is a cross-sectional view of another embodiment wherein the second opening is positioned differently.

Namely, in the embodiment illustrated in FIG. 3, a second opening $8_2$ is provided in the wall 4 of the air intake passage, which second opening $8_2$ is positioned upstream of the throttle valve 2 when the first opening $7_1$ is downstream of the edge $3_2$ thereof (i.e. when the throttle valve 2 is in a position indicated by the solid line). However, opening $8_2$ becomes positioned downstream of the throttle valve 2 when the first opening $7_1$ becomes positioned upstream thereof as the throttle valve 2 opens (i.e. when the throttle valve 2 is in a position indicated by the dot-dash line).

In the embodiment shown in FIG. 3, the second opening $8_2$ is always upstream of the throttle valve 2 when the first opening $7_1$ is downstream thereof, and, accordingly, no fuel is supplied from the second opening $8_2$ at such time.

The second opening $8_2$ in the embodiment of FIG. 3 is not always positioned downstream of the throttle valve, such as is the second opening $8_1$ illustrated in FIGS. 1 and 2. Therefore, the supply of fuel during idling (wherein throttle valve 2 is in the solid line position) is not disturbed. Fuel will thus be injected into passage 1 through opening $8_2$ only when the throttle valve is moved into its low speed position as indicated by the dash-dot line.

Figure 4:
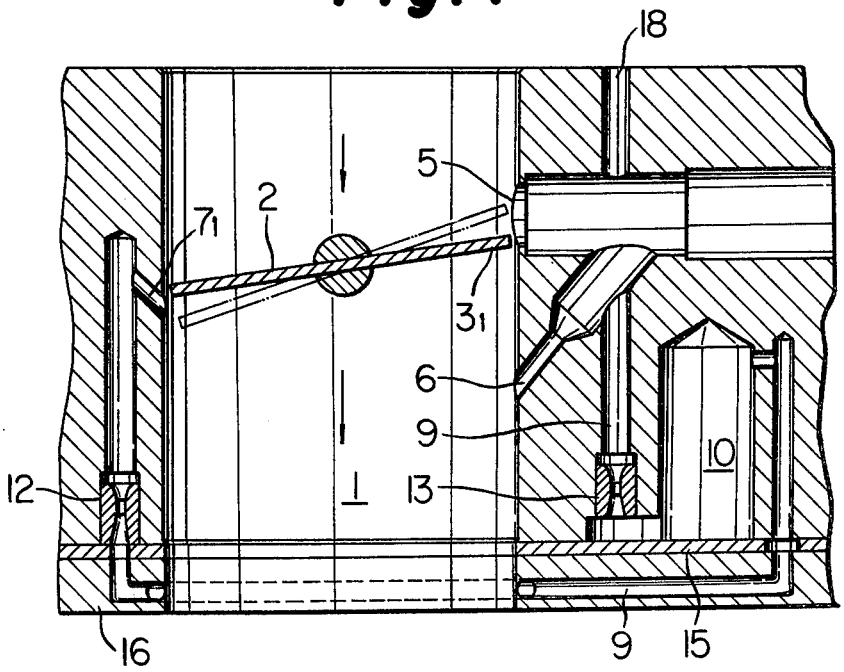
FIG. 4 is a cross-sectional view of still another embodiment wherein the slow port is used as the second opening.
Figure 5A:
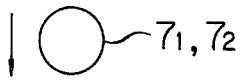
FIGS. 5(*a*) through 5(*d*) are four front views showing different shapes of the first opening.
Figure 5B:
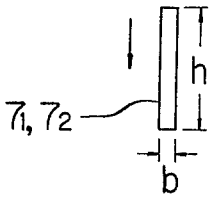
Figure 5C:
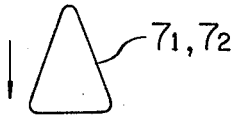
Figure 5D:
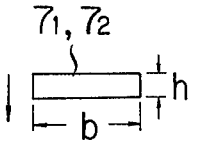

FIG. 4 shows a preferred embodiment of this invention in which the slow port is used as the second opening.

A passage 18 adapted to supply fuel to the slow port 5 and the idle port 6 also serves as a fuel supply passage to the fuel reservoir 10. The passage 18 is connected to that portion of the passage 9 which is closer to the slow port 5 than the jet 13. Therefore, the fuel for the reservoir 10 is supplied through the passage 18, the passage 9, and the jet 13. No further description will be given as to the structure of this embodiment, since it is the same as that illustrated in FIG. 1.

When the position of the first opening $7_1$ in the above-described embodiment changes from downstream to upstream of the throttle valve 2 as said throttle valve 2 rotates from the idle position indicated by the solid line to the low-speed position indicated by the dot-dash line, the slow port 5 becomes positioned downstream of the edge $3_1$ of the throttle valve 2, whereupon the balance between the pressures working on the first opening $7_1$ and the second opening, namely the slow port 5, is broken. Then, the fuel in the passage 9 and the fuel reservoir 10 is injected from the slow port 5 into the passage 1 at a very rapid response speed.

In the above-described embodiments shown in FIGS. 1 to 4, the passage 9 is provided in the heat insulator 16 for the purpose of facilitating the manufacture of the apparatus. However, the passage 9 may be provided in the wall of the air intake passage of the carburetor.

Further, no definition was given as to the cross-sectional shape of the first opening $7_1$ or $7_2$ in such embodiments illustrated in FIGS. 1 through 4. However, it may be designed, without being limited thereto, like any of shapes shown in FIGS. 5(*a*) through 5(*d*).

The cross-section shown in FIG. 5(*a*) is almost circular. The first opening $7_1$ or $7_2$ of this shape has an average responding characteristic, with the stream of sucked air flowing from above to below as indicated by the arrow.

The cross-section shown in FIG. 5(*b*) is a vertical slit consisting of a length *h* and a relatively smaller width *b*. This opening permits the open area to progressively increase depending on the opening of the throttle valve. To be more precise, this type of opening is adapted to operate the compensation apparatus of this invention when the throttle valve rotates abruptly.

The cross-section shown in FIG. 5(*c*) is a triangle whose cross-sectional area grows smaller toward the upstream side, and larger toward the downstream side of the throttle valve. This type of opening $7_1$ or $7_2$ is intended for increasing the operational effect of the compensation apparatus with an increase in the rotating speed and the opening of the throttle valve.

The cross-section shown in FIG. 5(*d*) is a horizontal slit consisting of a short length *h*, in the direction in which the stream of sucked air flows, and a relatively greater width *b*, so that the entirety of the first opening $7_1$ or $7_2$ is positioned upstream of the throttle valve 2 when said throttle valve 2 opens or rotates even slightly. The opening of this type can respond to the slightest rotation of the throttle valve 2.

As understood from the above, this invention can prevent the diluting of fuel-air mixture in any transitional region, and can also prevent the shortage of fuel due to the delayed response of the mechanically operated accelerating pump. This in turn prevents lowering of drivability due to non-uniform rotation of the engine, thus relieving the passenger from an uncomfortable feeling. Conventionally, somewhat richer fuel-air mixtures have been selected for use with the mechanically operated accelerating pump because of the delay in its response. However, the use of such richer fuel-air mixtures is not desirable from the viewpoint of emission control. This invention, having eliminated such response delay, no longer necessitates the use of a conventional richer fuel-air mixture. This is conducive to removing toxic components in the exhaust gases, too.

As apparent from FIGS. 1–4, the first and second openings (for example $7_1$ and $8_1$) are disposed on substantially diametrically opposite sides of the air intake passage 1, and are also located on opposite sides of the hinge axis for the throttle plate, which axis extends transverse to the intake passage 1.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a carburetor having wall means defining an air intake passage, a throttle member positioned within said intake passage and mounted for swinging movement about an axis which is substantially transverse to said passage, and a fuel supply port communicating with said intake passage in the vicinity of said throttle member, the improvement comprising compensating means for supplying additional fuel to said intake passage when the throttle member is moved into a preselected position to attain a more desirable fuel-air ratio in a transitional region between different operational conditions, said compensating means including:

a first opening formed in said wall means and communicating with said intake passage near the edge of said throttle member, said first opening being positioned upstream or downstream of said throttle member depending on the degree of opening thereof, the first opening being upstream of the throttle member when the throttle member is moved into said preselected position;

a second opening provided in said wall means and communicating with said intake passage, said second opening being positioned downstream of said throttle member at least when said throttle member is in said preselected position;

an intermediate fuel supply chamber formed in said wall means;

fuel supply passage means communicating with said intermediate fuel supply chamber for supplying fuel thereto and for maintaining a quantity of fuel therein;

a first connecting passage joining said first opening to said intermediate fuel supply chamber, and a second connecting passage joining said intermediate fuel supply chamber to said second opening, said first and second connecting passages being isolated from one another by the fuel within said intermediate chamber so that direct flow of air from said first passage into said second passage is prevented;

whereby when said throttle member is in said preselected position, the pressure upstream of the throttle member is greater than the pressure downstream of the throttle member so that the pressure differential which exists between the first and second openings causes fuel within said intermediate chamber to be discharged through said second opening into said air intake passage.

2. A carburetor according to claim 1, wherein said fuel supply port also comprises said second opening, and said fuel supply passage means including a passage portion communicating with said fuel supply port and said second connecting passage, said second connecting passage having a nozzle-like flow restriction device associated therewith.

3. A carburetor according to claim 1, wherein said first and second openings are located on substantially opposite sidewalls of the air intake passage and are also located radially outwardly from and on opposite sides of the axis for the throttle member.

4. A carburetor according to claim 3, wherein the air intake passage is substantially cylindrical, the axis for said throttle plate extending substantially perpendicular to and substantially intersecting the longitudinally extending axis of the air intake passage, and the first and second openings being located on substantially diametrically opposite sides of the air intake passage.

5. A carburetor according to claim 1, including a second fuel supply port communicating with said intake passage downstream of said throttle member, said second fuel supply port being disposed downstream from said first-mentioned fuel supply port for supplying fuel to said intake passage under idle conditions, and said second opening being independent of said first-mentioned and second fuel supply ports.

6. A carburetor according to claim 5, wherein said second opening communicates with said intake passage near the edge of said throttle member, said second opening being positioned upstream or downstream of the throttle member depending upon the degree of opening thereof, the second opening being downstream of the throttle member when the throttle member is moved into said preselected position.

7. A carburetor according to claim 1, wherein said second connecting passage has a nozzle-like flow restriction device associated therewith.

8. A carburetor according to claim 7, wherein said first connecting passage also has a nozzle-like flow restriction device associated therewith.

9. A carburetor according to claim 7, wherein said first connecting passage communicates with an upper portion of said intermediate chamber, and wherein said second connecting passage communicates with a lower portion of said intermediate chamber, said second connecting passage communicating directly with the quantity of fuel stored within said intermediate passage.

* * * * *